United States Patent [19]

Ventrice

[11] 4,223,498

[45] Sep. 23, 1980

[54] PREFABRICATED SWIMMING-POOL CONSTRUCTION

[75] Inventor: Raymond Ventrice, West Caldwell, N.J.

[73] Assignee: Swim 'N Play, Inc., Newark, N.J.

[21] Appl. No.: 8,054

[22] Filed: Jan. 31, 1979

[51] Int. Cl.[2] ..... E04G 11/06; E04G 7/02

[52] U.S. Cl. ..... 52/249; 403/388; 220/75; 220/80; 29/526 R; 4/506

[58] Field of Search ..... 52/249, 164.7; 403/388; 220/75, 80, 5 A; 4/172.19

[56] References Cited

U.S. PATENT DOCUMENTS

| | | | |
|---|---|---|---|
| 636,766 | 11/1899 | Davis | 220/75 |
| 647,293 | 4/1900 | Crease | 220/75 |
| 1,811,659 | 6/1931 | Andrake | 29/526 |
| 1,894,675 | 1/1933 | Dixon | 220/80 |
| 2,939,153 | 6/1960 | Arnold et al. | 4/172.19 |

*Primary Examiner*—James L. Ridgill, Jr.

*Attorney, Agent, or Firm*—Hopgood, Calimafde, Kalil, Blaustein & Lieberman

[57] ABSTRACT

The invention contemplates an improved construction of the reinforced ends of flexible sheet-metal panels used in defining the basic generally cylindrical wall to be lined with flexible material in the erection of a prefabricated swimming pool. The end-reinforcement structure uses substantially thinner-gage material than heretofore, and yet a secured joint of two lapped panel ends has the hoop-tension resistance of the best of previous constructions without presenting any ambiguity regarding the sense (i.e., overlapped relation of parts) at the overlap.

5 Claims, 7 Drawing Figures

PREFABRICATED SWIMMING-POOL CONSTRUCTION

BACKGROUND OF THE INVENTION

The present invention relates to swimming pools, and more particularly to above-ground prefabricated swimming pools in which common components can be used to construct pools of different sizes.

In the design and construction of prefabricated above-ground pools, the cost of fabricating standard components is a major consideration. It is necessary to provide pools of a variety of sizes to accommodate the available space and the diverse desires of consumers, and the variety of components necessary for the construction of such pools is thus very large. Accordingly, the cost of manufacturing the prefabricated pool components is increased because production runs are shorter. Additionally, distributors and retailers of pools must carry large inventories, a problem which is particularly acute in areas where the sale of pools is highly seasonal.

In swimming pools of the character indicated, a flexible liner which contains pool water is backed by upstanding wall structure which includes one or more elongate rectangular sheet-metal panels secured in end-to-end overlapped relation to complete the peripheral continuity and generally cylindrical contour of the pool. It has been the practice to reinforce each of the ends of such panels with a relatively thick metal bar or strap which is preassembled to the panel end, as by grommets. The sheet metal of the panel ends is usually folded back on itself to define a double-thickness hem, and the reinforcement bar is preassembled to one side of the hem at one longitudinal end of the panel, while the other reinforecement bar is preassembled to the other side of the hem at the opposite longitudinal end of the panel.

It is vitally important to the ultimate hoop-stress integrity of a pool having walls completed by connection of such reinforced ends that the lap of the ends which are secured shall be with a sheet-metal to sheet-metal interface, so that securing bolts through aligned spaced apertures in the lapped reinforced ends may seat directly upon the reinforcing bars and thus use the bars as clamps for the effectively uniform distribution of clamping effort along the length of the lapped panel ends. For this reason, instructions furnished with kits of prefabricated pool parts are so clear and emphatic regarding the correct method of ultimate assembly that the manufacturer's guarantee on the finished pool will be voided if this instruction as to cylindrical wall assembly has been disregarded.

To make a claim under such a guarantee, the customer must return the allegedly defective part, and the "defect" will be clear if the pool has a ruptured metal wall at the region of the bolted overlap of panel ends. If rupture occurs, the very great probability is that the assembly instruction was not heeded, meaning that the lapped-end interface was reinforcement-bar to reinforcement bar, rather than sheet metal to sheet metal as instructed. Actually, the "defect" will be demonstrably the fault of a person (often the ultimate customer) who disregarded the instructions.

While it is easy to avoid a guarantee when the cause of damage is attributable to the customer and not to the product, it is nevertheless bad business to avoid a guarantee, whoever is at fault.

SUMMARY OF THE INVENTION

It is an object of the invention to provide an improved swimming pool wall-panel construction of the character indicated, wherein the pool ultimately constructed by persons other than the manufacturer may be of equal quality and performance whatever the sense of the lap, at bolted connection of adjacent wall-panel ends.

Another object is to provide a sheet-metal wall-backup structure for such a swimming pool wherein the critical importance of a particular assembly procedure is eliminated.

A further object is to achieve the foregoing objects with structure which need use no more reinforcement material than heretofore, and which will be essentially foolproof in regard to its ultimate assembly and erection.

Other objects and various further features of novelty and invention will be pointed out or will occur to those skilled in the art from a reading of the description below as to a preferred embodiment.

Briefly, the invention contemplates an improved construction of the reinforced ends of flexible sheet-metal panels used in defining the basic generally cylindrical wall to be lined with flexible material in the erection of a prefabricated swimming pool. The end-reinforcement structure uses substantially thinner-gage material than heretofore, and yet a secured joint of two lapped panel ends has the hoop-tension resistance of the best of previous constructions without presenting any ambiguity regarding the sense (i.e., overlapped relation of parts) at the overlap.

DESCRIPTION OF THE PREFERRED EMBODIMENT

The accompanying drawings are to be considered in the light of ensuing description. In said drawings.

Figure 1:
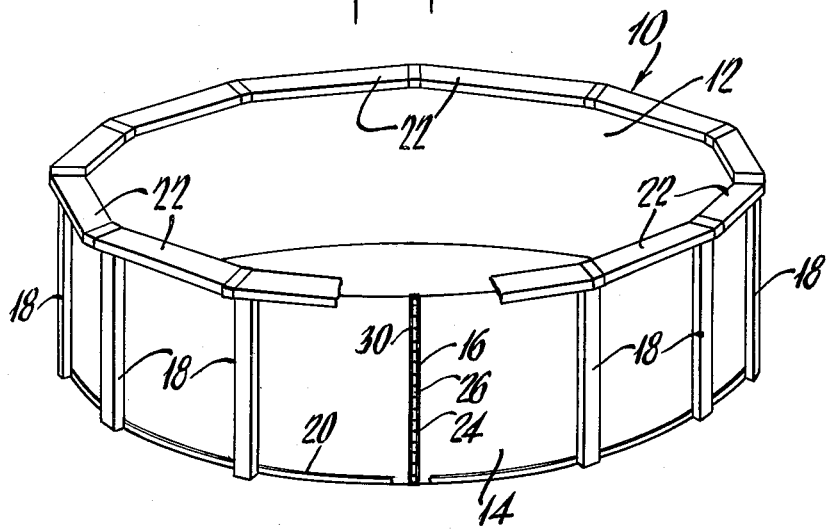
FIG. 1 is a simplified perspective view of a pool which may incorporate wall structure of the invention.

The invention is used in the construction of a prefabricated part of an above-ground swimming pool of the type indicated 10 in FIG. 1. The pool includes a liner 12 formed of flexible vinyl sheet disposed within an upstanding generally cylindrical wall 14 erected in the conventional manner by bending an elongate single rectangular sheet or panel (preferably of aluminum) and joining the panel ends at a joint location indicated 16. Supporting structure for the wall 14 includes spaced vertical posts 18, connected rails 20 for seated accommodation of the bottom edge of wall 14, and connected upper-ledge members 22 at the top of the wall 14.

The invention is concerned with the prefabrication of the wall panel 14, in a manner to simplify its ultimate erection and assembly, particularly at joint 16. But for a better understanding of the invention it is first necessary to consider the prior art, represented by FIGS. 2, 2A and 2B.

Figure 2:
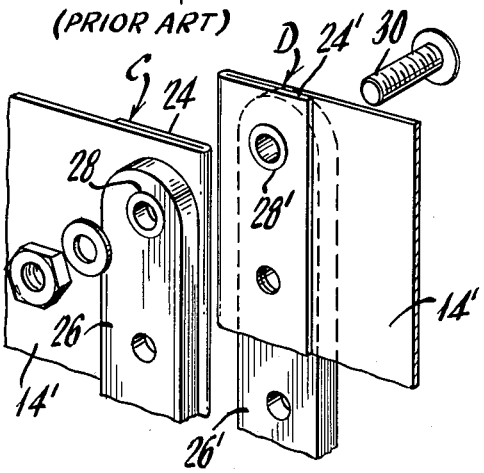
Fig.2. (PRIOR ART)
FIG. 2 is an enlarged fragmentary exploded view of unassembled ends of sheet-metal wall panels of the prior art, as used in completing a pool of the character shown in FIG. 1.

In FIG. 2, the prefabricated wall panel 14' has been bent to cylindrical shape, except that its longitudinal ends C-D have not yet been lapped and bolted. As seen in FIG. 2, the end C, as prefabricated, comprises an edge portion or hem 24 of the sheet material folded back on itself, and a relatively thick single reinforcing metal strip 26 (preferably also of aluminum) assembled to one side, here the outer side, of the hem-folded region. Spaced grommets, as at 28, retain the reinforcing strip 26 to both sheet-metal thicknesses at the hem region, the fold edge of the hem being preferably slightly offset from the region of strap 26 overlap. Plural registering apertures at close spacing along the length of the thus-reinforced panel end C enable bolted assembly to the other panel end D. For this purpose, the panel end D is of similar construction and therefore corresponding parts at end D have been given corresponding reference numbers, with primed notation. It will be noted that the single reinforcement strip 26' for the panel end D is preassembled to the double-thickness hem region 24', on the inner side of wall 14'.

Figure 2A:
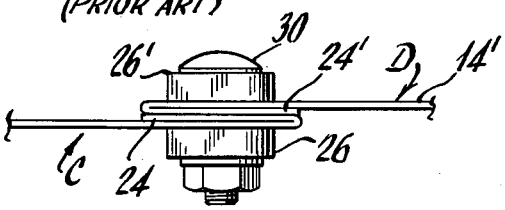
Fig.2A. (PRIOR ART)
FIGS. 2A and 2B are similar fragmentary end views of completed joints between lapped ends of prior-art panels as shown in FIG. 2, the view of FIG. 2A representing a correctly assembled joint, and the view of FIG. 2B representing an incorrectly assembled joint.

Manufacturers' instructions for pool construction make it imperative and clear that the lapped-end relation shown in FIG. 2A must exist if sufficient circumferential integrity is to be achieved in wall 14' when the ends C-D are jointed, by bolting through all aligned apertures at the lapped ends. In FIG. 2A, this relationship is seen to involve a lapped interface of panel sheet metal to panel sheet metal, with the reinforcement strips 26-26' along the outer side and along the inner side of the joint. This being the case, bolt alignment (as suggested at 30) permits plural secured bolts to clamp the sheet-metal regions to each other with a relatively uniform distribution of clamping force, reflecting the bending-resistance characteristics of the relatively thick outer reinforcing (and now clamping) strips 26—26'. Generally, these strips 26—26' are each of at least $\frac{1}{8}$-inch thickness, so that overall joint thickness that is compressed between each secured nut and bolt is in the order of 5/16-inch. Assembled as in FIG. 2A, a perfectly good durable product results, with an adequate margin of safety to resist hoop-tension rupture when the pool is filled and in use.

Figure 2B:
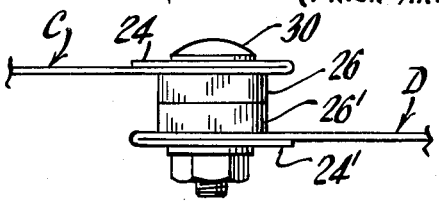
Fig.2B. (PRIOR ART)

On the other hand, if through carelessness, the joint between panel ends is made by reversing the sense of the lap, as indicated in FIG. 2B, there is no inherent safety in the bolted assembly, for the reinforcing strips 26—26' define the joint interface, and the sheet metal of the hemmed ends is exposed, toward the inside and toward the outside of the pool. In short, the strips 26—26' can perform no clamping function; moreover, they define a 0.250-inch offset of the sheet metal of one from the other of the lapped panel ends. Hoop tension therefore is no longer uniformly distributed along the length of the joint, and localized rupturing forces are fatally severe at each bolt alignment. The greatest rupturing forces develop at the lower regions of the joint, but once a rupture begins, it progresses rapidly upward, with disastrous consequences.

The invention avoids the above-noted deficiency of the prior art by providing reinforcing strips 32—32' and 33—33' assembled by grommet means 34—34' to each side of each end (E-F) of the sheet metal panel 14, so that a bolted later assembly of the lapped panel ends will be of equal quality regardless of the sense of the lap at the joint. Thus, the two possible senses of the lap, respectively shown in FIGs. 3A and 3B, produce joints of equal quality.

Figure 3:
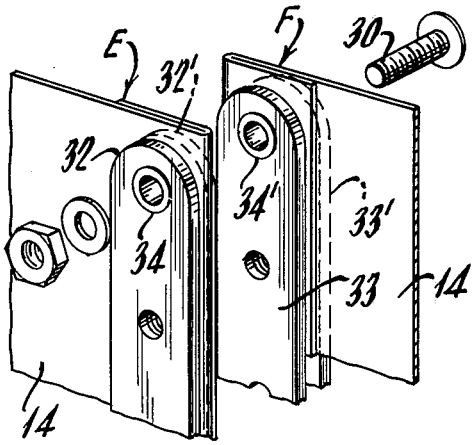
FIG. 3 is a view similar to FIG. 2 to show a panel-subassembly construction of the invention.
Figure 3A:
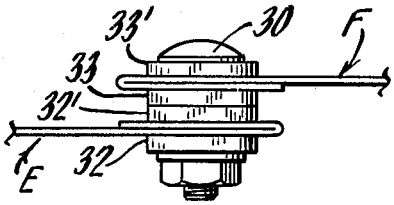
FIGS. 3A and 3B are views similar to FIGS. 2A and 2B, respectively, except that both of FIGS. 3A and 3B illustrate correct assembly.
Figure 3B:
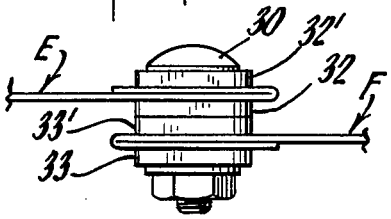

Surprisingly, it has been determined that the desirable results of the FIG. 3 construction is achievable with strips 32—32' and 33—33' which are duplicates of each other and which are of individual thickness, representing approximately one half that of strips 26—26'. Thus, the preassembly of strips 32—32' to the hemmed end at E, via grommets as at 34, involves a combined thickness which may be the exact equal of that for strip 26 assembled to the hem C of FIG. 2. Generally, for a preferably aluminum metal strip at 32—32'-33—33', a suitable thickness range of 0.050 to 0.100 inch is stated, with a preference for approximately 1/16-inch. Also, preferably, the region of strip overlap with the associated hem region at E (and at F), is offset inside the fold edge of the hem, as shown, so that clamping force is not applied directly to the fold-edge region.

It will be seen that the described wall-panel construction of the invention meets all stated objects and provides the manufacturer with a product which does not invite disastrous mistake or carelessness by or on behalf of the ultimate customer. This means virtual elimination of hoop-tension rupture at wall-panel joints, with enhanced pleasure and satisfaction to the customer and a striking reduction in unjustified claims against the manufacturer. Moreover, since the reinforcement strips used in FIG. 3 may be of approximately half the thickness of the strips used in the prior art (FIG. 2 ), the overall thickness of all joints remains as previously, regardless of the sense in which the joints are lapped.

While the invention has been described in detail for the preferred form shown, it will be understood that modifications may be made without departure from the claimed scope of the invention.

What is claimed is:

1. In a prefabricated swimming-pool construction wherein a flexible-sheet liner is backed by generally cylindrical peripherally continuous upstanding wall structure and wherein the wall surface adjacent the upstanding portion of the liner includes an elongate rectangular sheet-metal panel adapted to conform to a predetermined circumferential wall contour, each of the respective longitudinal ends of said panel being in independently preassembled relation with a metal reinforcement strip of predetermined thickness secured along and adjacent the panel end, and said strips and sheet metal at said ends having apertures at spaced locations along said strips, said apertures being aligned for bolting through both strips for a later-assembled overlapped-end relation of two adjacent ends of such panel or panels, the improvement wherein for each of said preassembled panel ends, said reinforcement strip is one of two, secured to each other on opposite sides of the end of the panel, with aligned bolt apertures through both the strips at each end of the panel, the thickness of each of the two reinforcement strips secured to each end of the panel being substantially less than said predetermined thickness, whereby the hoop-tension strength of a bolted and lapped later assembly of two panel ends thus doubly reinforced is substantially the same regardless of the front-to-back or back-to-front lapped relation of the lapped ends.

2. The improvement of claim 1, in which at each panel end the sheet metal thereof is folded back on itself to define a double-thickness sheet-metal hem, the two reinforcement strips along each such end being assembled to the panel end in registering overlap with both sides of said hem.

3. The improvement of claim 2, in which said registering overlap is completely offset from the fold edge of said hem, whereby clamping pressure resulting from bolted connection of two lapped panel ends is not applied directly to said fold edge.

4. The improvement of claim 1, in which said panel is of aluminum sheet and said strips are of aluminum in the thickness range of 0.05 to 0.10 inch.

5. The improvement of claim 1, in which said panel is of aluminum sheet and said strips are of aluminum of substantially 1/16-inch thickness.

* * * * *